United States Patent [19]

Marttinen

[11] Patent Number: 4,562,611

[45] Date of Patent: Jan. 7, 1986

[54] AUTOMATIC DUMPING DUST PAN

[76] Inventor: Alpo L. Marttinen, 423 Sydenham Rd., Sault Ste. Marie, Ontario, Canada, P6C 2X8

[21] Appl. No.: 635,602

[22] Filed: Jul. 30, 1984

[30] Foreign Application Priority Data

Feb. 28, 1984 [CA] Canada ..... 448453

[51] Int. Cl.[4] ..... A47L 13/52

[52] U.S. Cl. ..... 15/257.7; 294/1.4; 294/53.5

[58] Field of Search ..... 294/1 BA, 1 BB, 9, 53.5, 294/55; 15/104.8, 257.1, 257.4, 257.6, 257.7

[56] References Cited

U.S. PATENT DOCUMENTS

| | | | |
|---|---|---|---|
| 77,358 | 4/1868 | Colby . | |
| 357,408 | 2/1887 | Pittenger | 294/53.5 |
| 473,004 | 4/1892 | Hull . | |
| 642,412 | 1/1900 | Anderson . | |
| 676,424 | 6/1901 | Depew | 15/257.7 |
| 689,156 | 12/1901 | Benham . | |
| 774,994 | 11/1904 | Snedeker . | |
| 844,168 | 2/1907 | Murray | 15/257.7 X |
| 916,767 | 3/1909 | Ogden | 15/257.7 |
| 953,756 | 7/1909 | Olson . | |
| 1,169,939 | 2/1916 | Dupre . | |
| 1,176,531 | 3/1916 | Fite et al. | 294/53.5 |
| 1,261,859 | 4/1918 | Seiter | 294/53.5 |
| 2,699,050 | 1/1955 | MacKay | 294/55 X |
| 3,868,135 | 2/1975 | Magliaro . | |

FOREIGN PATENT DOCUMENTS

| | | | |
|---|---|---|---|
| 257701 | 2/1926 | Canada . | |
| 564654 | 10/1958 | Canada . | |
| 657435 | 2/1963 | Canada . | |
| 2974 | 4/1900 | Denmark | 294/53.5 |
| 109977 | 3/1944 | Sweden | 294/53.5 |

*Primary Examiner*—Johnny D. Cherry

*Attorney, Agent, or Firm*—Russel S. Smart; Donald F. Phenix; Stewart L. Gitler

[57] ABSTRACT

A long-handled self-dumping dust pan is adapted to be used by a person standing in an upright position. Long-handled dust pans of varying shapes and sizes are known. Those which are automatic dumping however, are complex, heavy and expensive to produce. The present invention overcomes these disadvantages by providing a simple, easy to produce, long-handled dust pan. It is equipped with a lever positioned close to the operator's hand which disengages a detent from a recess in the pan, thereby allowing the refuse to fall into a suitable container.

2 Claims, 6 Drawing Figures

AUTOMATIC DUMPING DUST PAN

BACKGROUND OF THE INVENTION

This invention relates to a dust or dirt gathering apparatus and more particularly a long-handled dust pan for household cleaning.

Dust pans of numerous shapes and sizes are known in the art. Numerous attempts have been made to provide a dust pan which could be used by a person who is standing up; therefore eliminating the need to bend over. This is particularly important to the elderly user. In addition to providing a long handle, the ability to release the pan portion to a vertically downwards position in order to remove the contents is also a desirable characteristic. The ability to release the pan while the operator remains in the upright position is a further desirable feature.

Prior art self-dumping long-handled dust pans such as U.S. Pat. Nos. 473,004, 774,994 and 1,169,939 have three disadvantages. These are complex construction, excessive weight and bulk, and high cost. The present invention overcomes these difficulties by providing a simple, effective, lightweight dust pan which is inexpensive to produce.

SUMMARY OF THE INVENTION

Therefore, this invention provides an apparatus for gathering refuse comprising an elongate handle, a dust pan pivotally mounted on said handle for movement between an operative and a dumping position; a retaining means at the lower end of said handle which engages said dust pan in the operative position; and an actuator means located at the upper portion of said handle, connected to the retaining means, and operative to disengage said retaining means to permit movement of the dust pan to the dumping position.

BRIEF DESCRIPTION OF THE DRAWINGS

The invention is more fully described in relation to the accompanying drawings wherein.

DESCRIPTION OF THE PREFERRED EMBODIMENTS

Figure 1:
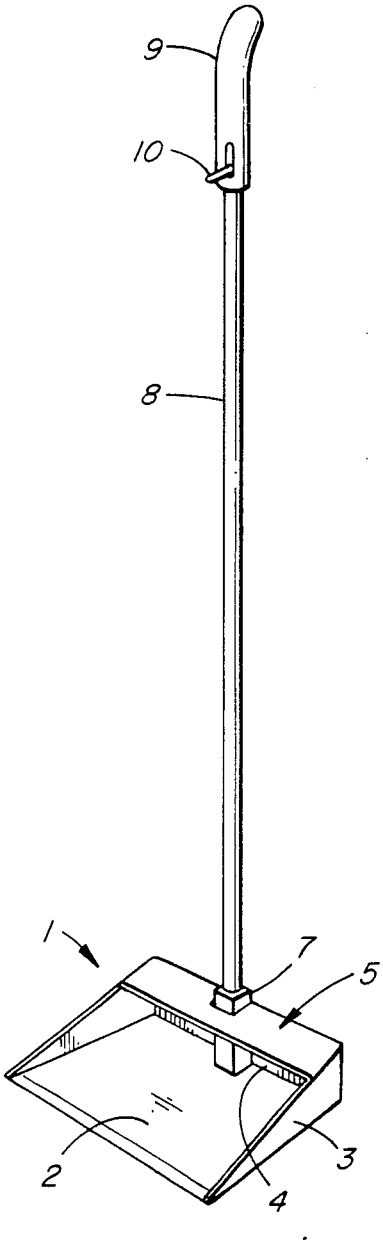
FIG. 1 is a perspective view of the invention in the operative position.

In FIG. 1 a dust pan 1 is shown in the operative position. In this position the bottom 2 of the dust pan is in a horizontal position with the sides 3 and the rear 4 of the pan being perpendicular to the floor (not shown). The dust pan has a partial top 5 through which the hollow block 7 attached to the handle 8 passes. The top of the handle 8 has a hand grip 9 from which protrudes an actuating means 10.

Figure 2:
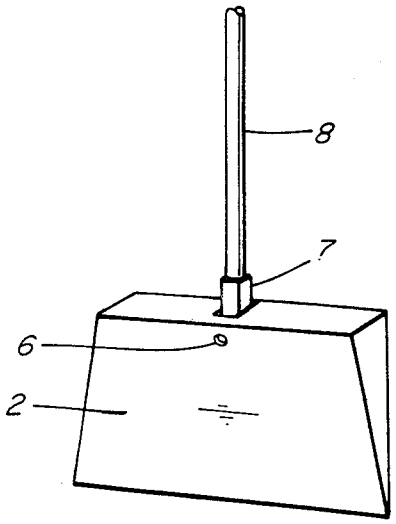
FIG. 2 is a perspective view of the invention in the storage or dumping position.

In FIG. 2 the recess 6 located on the bottom side 2 of the dust pan 1 at the rear thereof appears because the dust pan is in the dumping or storage position. Furthermore, in this position the bottom 2 of the dust pan hangs vertically downwards.

Figure 3:
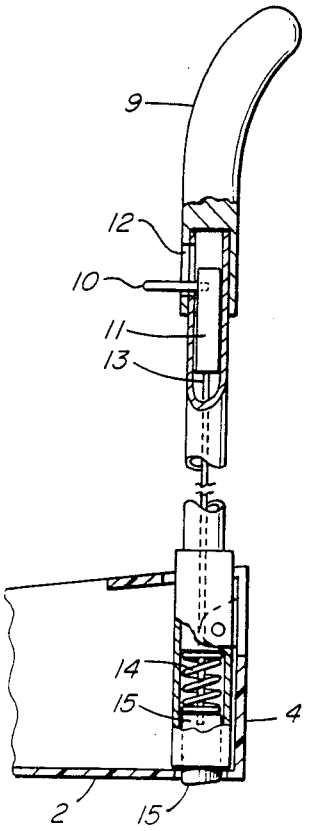
FIG. 3 is a cutaway side view of the internal components within the hollow handle.
Figure 4:
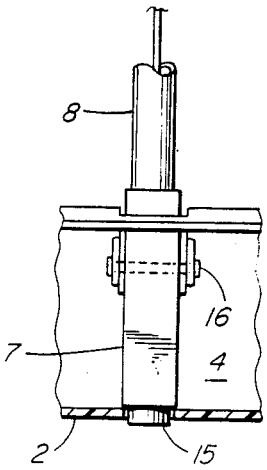
FIG. 4 is an enlarged view of the area of connection between the handle and the pan.
Figure 5:
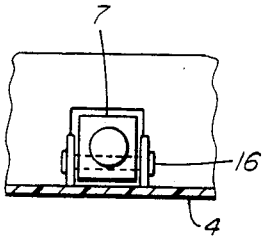
FIG. 5 is a top view of the block portion where the peg is located.

In FIG. 3 is shown the internal workings for activating the dumping mechanism. The actuating means 10 is formed with a solid block 11 which moves upwards and downwards within the hollow handle 8 with a lever protruding through an opening 12 formed within the hand grip 9. The block 11 is fixedly secured to a connecting means 13 such as a rod or cable which connects through a spring 14 to a detent 15. When the actuating means is not operated by the user, the spring 14, which abuts at one end against the pivotal rod 16, exerts pressure upon the detent 15 at its other end thereby firmly engaging the end of the detent 15 into the recess 6. In this position, the operator may sweep refuse into the dust pan as well as carrying it from place to place without danger of spilling refuse.

When an operator wishes to dump the refuse, the actuating means 10 is pulled upwards thereby exerting pressure upon the spring 14 and moving the detent 15 upwards thereby disengaging the recess 6. At this time the dust pan falls vertically downwards, hingedly hanging on a pivotal rod 16. When the operator wishes to again use the dust pan in the operative position, he engages the actuating means while simultaneously placing the bottom 2 of the dust pan 1 in a horizontal position resting upon the floor. With the handle in a basically vertical position, and the dust pan bottom horizontal, the actuating means is disengaged and the detent descends to become securely fixed within the recess 6.

Figure 6:
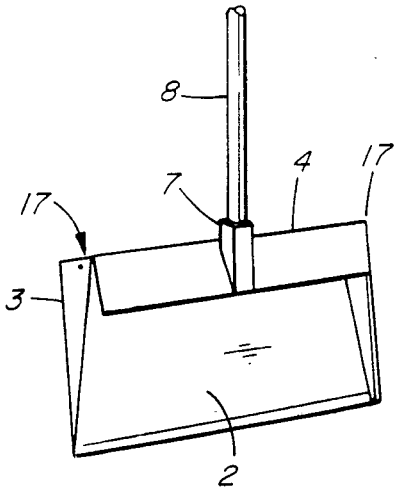
FIG. 6 is a perspective view of an alternative embodiment.

FIG. 6 is an alternative embodiment of the invention. The back 4 of the dust pan 1 is fixedly attached to the handle 8. The back and handle are hingedly attached to the dust pan on the upper rear corners of the sides at points 17. When the actuating means 10 is activated the detent disengages the recess and the dust pan comprising the sides and bottom rotates vertically downwards.

It is understood that the aforementioned explanation of a preferred embodiment of the invention does not limit the scope of the invention, which is capable of numerous combinations or variations.

What I claim as my invention is:

1. An apparatus for gathering refuse comprising:

(a) an elongated hollow handle having an upper end and a lower end, (b) a dust pan including a bottom, a rear wall, and a partial top that extends parallel to the bottom, (c) a hollow block secured to the lower end of said handle and projecting through said partial top of said dust pan, (d) first means extending through said hollow block to secure said dust pan to said handle for pivotal movement relative thereto, (e) said bottom of said dust pan having a recess formed therein, (f) a detent located at the lower end of said hollow block for engagement with said recess in said dust pan, to lock said dust pan in a horizontal orientation, (g) a rigid rod extending axially through the interior of said hollow handle, (h) manually operable actuating means secured to the upper end of said hollow handle, and (i) one end of said rod being secured to said actuating means and the other end of said rod being secured to said detent, whereby operation of said actuating means releases said detent from said recess in said dust pan to pivot into a depending, vertical position to discharge the contents of said pan.

2. An apparatus for gathering refuse as claimed in claim 1, further comprising a spring located at the lower end of said hollow block extending from said detent to said first means for urging said detent into said recess of said dust pan, thereby fixedly securing said dust pan to said handle.

* * * * *